US005536996A

United States Patent [19]

Vijlbrief

[11] Patent Number: 5,536,996

[45] Date of Patent: Jul. 16, 1996

[54] ANTI-IMPLOSION BAND IN A CATHODE RAY TUBE HAVING IMPROVED STRUCTURE FOR PROTECTING SUSPENSION ELEMENTS

[75] Inventor: Frank C. Vijlbrief, Eindhoven, Netherlands

[73] Assignee: U.S. Philips Corporation, New York, N.Y.

[21] Appl. No.: 514,513

[22] Filed: Aug. 11, 1995

Related U.S. Application Data

[63] Continuation of Ser. No. 190,409, Feb. 2, 1994, abandoned.

[30] Foreign Application Priority Data

Feb. 3, 1993 [EP] European Pat. Off. ..... 93200271

[51] Int. Cl.[6] ..... H01J 31/00

[52] U.S. Cl. ..... 313/477 R; 313/482; 220/2.1 A

[58] Field of Search ..... 313/477 R, 482; 220/2.1 A, 2.3 A; 348/821, 822

[56] References Cited

U.S. PATENT DOCUMENTS 3,730,990 5/1973 Miyata et al. .

4,586,087 4/1986 Parsons et al. ..... 220/2.3 A 4,668,993 5/1987 Hermann ..... 220/2.1 A

FOREIGN PATENT DOCUMENTS 0421537 4/1991 European Pat. Off. .

57-111935 7/1982 Japan .

60-62039 4/1985 Japan .

*Primary Examiner*—Sandra L. O'Shea

*Assistant Examiner*—Vip Patel

*Attorney, Agent, or Firm*—John C. Fox

[57] ABSTRACT

An anti-implosion band (4) for a cathode my tube comprises a suspension element (5) on its corners with the suspension element having a suspension aperture (8). The suspension element has a portion (7) in which the suspension aperture (8) is formed. This portion extends transversely to the clamping band. The suspension element further comprises projections (9) which extend on one side of the band (4), transversely to the edge of the band, and, when viewed in projection on the plane of the clamping band, the opposite side (10) of the band falls within the projections of the suspension elements. The projections do not influence the clamping function of the band. The bands can be stacked in a simple manner.

6 Claims, 3 Drawing Sheets

ANTI-IMPLOSION BAND IN A CATHODE RAY TUBE HAVING IMPROVED STRUCTURE FOR PROTECTING SUSPENSION ELEMENTS

This is a continuation of previous application Ser. No. 08/190,409, filed Feb. 2, 1994, now abandoned, and all benefits of such parent application are claimed for this new application.

The invention relates to an anti-implosion band for a cathode ray tube having suspension elements which are secured to the anti-implosion band and which are provided with suspension apertures. The invention also relates to a cathode ray tube having such an anti-implosion band.

BACKGROUND OF THE INVENTION

Cathode ray tubes are used in, inter alia, television receivers, computer monitors and the like.

A cathode ray tube comprises an evacuated envelope having, in general, a cone portion and a display window portion, the latter portion having a raised edge.

To preclude that a cathode ray tube implodes, the tube is customarily provided with an anti-implosion band. In particular, for example metal bands are used which are provided around the envelope in a heated state and, after cooling, surround the envelope, in general the raised edge of the display window, under a mechanical stress. The anti-implosion band is provided with suspension elements. These elements have suspension apertures. By means of the suspension apertures the cathode ray tube is mounted in a cabinet.

An anti-implosion band of the type mentioned in the opening paragraph is known from European Patent Application EP 421537 A1. A cathode ray tube comprising such an anti-implosion band is also disclosed in this European Application. The known anti-implosion band is made in such a manner that anti-implosion bands can be stacked. For this purpose, the suspension elements are extended in a direction transverse to the anti-implosion band and, viewed in a direction transverse to the plane of the anti-implosion band, project relative to the anti-implosion band. In practice, however, the suspension elements of the known anti-implosion band have the disadvantage that the suspension apertures are susceptible to damage.

SUMMARY OF THE INVENTION

It is an object of the invention to provide an anti-implosion band of the type mentioned in the opening paragraph, in which the above drawback is at least largely overcome in a simple manner.

To this end, an anti-implosion band of the type described in the opening paragraph is characterized in that each suspension element comprises a portion which extends transversely to the outside of the anti-implosion band with this portion having a suspension aperture and at least one projection which extends transversely to the portion, the at least one projection extending in one of an upward or downward direction relative to the anti-implosion band and, when viewed in projection on a plane extending parallel to the anti-implosion band, the edge of the anti-implosion band located opposite to the at least one projection falls within the extent of the projection and the suspension apertures fall outside of the extent of the projection.

The anti-implosion band in accordance with the invention has at least one projection for each of the suspension elements, with these projections extending upwards or downwards relative to the anti-implosion band, and the opposite edge of the anti-implosion band, when viewed in a projection on the plane of the anti-implosion band, falling within the projections. By virtue thereof, the anti-implosion bands can be stacked. Viewed in projection, the suspension apertures for suspending the cathode ray tube in a cabinet fall outside the projections. Such a construction can be used for every known anti-implosion band and does not require a redesign of the anti-implosion band. In comparison with the known anti-implosion band, the risk that the suspension apertures or the portion of the suspension element in which the suspension aperture is formed are damaged during the stacking of the anti-implosion bands is reduced. In the construction known from EP 421 537 there is a substantial risk that, during stacking or transport of the anti-implosion bands, the edge of an anti-implosion band causes damage to the suspension elements or suspension apertures of the anti-implosion band on top of which this anti-implosion band is stacked. Damage to the suspension apertures or the relevant portion of the suspension element may cause problems during the mounting of the cathode ray tube in the cabinet, resulting in rejects or delay.

If the anti-implosion band is substantially rectangular, preferably, the suspension element comprises, with respect to the diagonal through the relevant comer, two projections on either side of the comer and, preferably, the suspension element is solidly constructed.

By using eight projections, two on each comer on either side of the comer, the anti-implosion bands can be stacked in a simple manner. The suspension element can be solidly constructed in a simple manner. Rotation of an anti-implosion band relative to an overlying or underlying anti-implosion band may cause the stack as a whole, which consults of a plurality of anti-implosion bands, to assume a helical shape. This has the following disadvantages: the stack takes up more space than it does when no rotation occurs and the stack is less stable, i.e. it is less likely to fall over or move.

BRIEF DESCRIPTION OF THE DRAWING AND FIGURES

These and other aspects of the invention will be explained in greater detail by means of an exemplary embodiment and with reference to the companying drawings, in which FIG. 1 is a diagrammatic perspective view of a cathode ray tube in accordance with the invention;

FIGS. 2A, 2B, 2C, 2D, 2E and 2F up to and including 2F are different perspective views of a corner of a clamping band having a suspension element;

DESCRIPTION OF THE INVENTION

Figure 1:
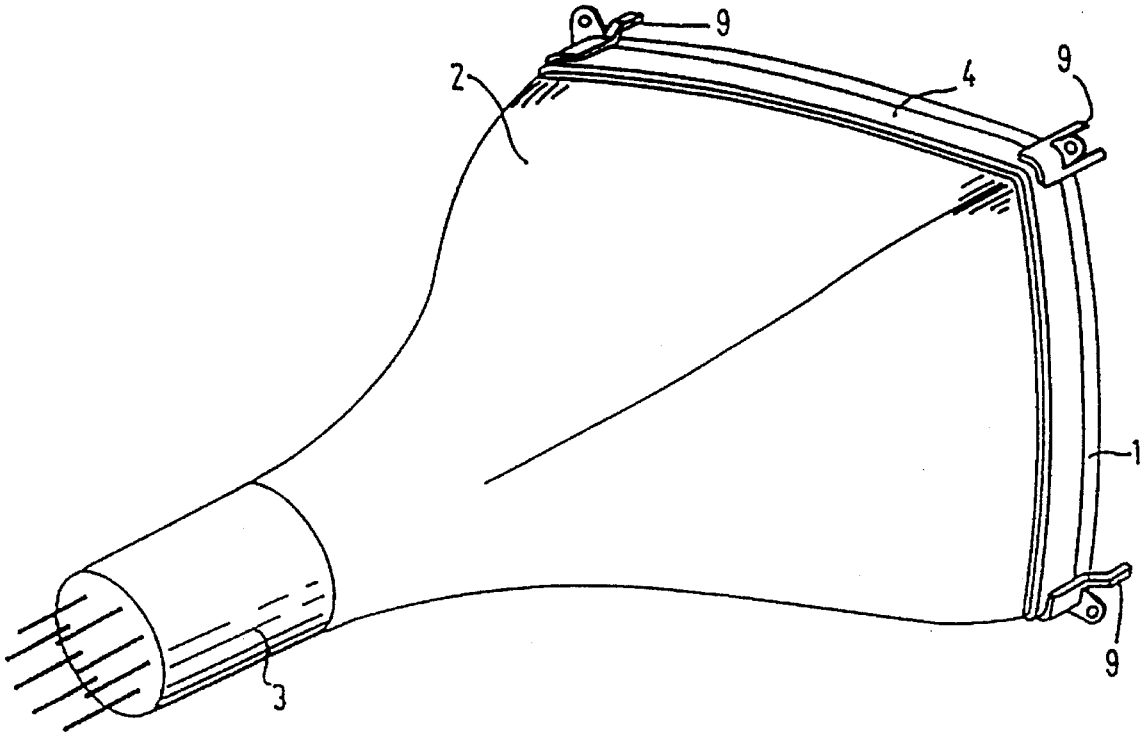
Figure 2A:
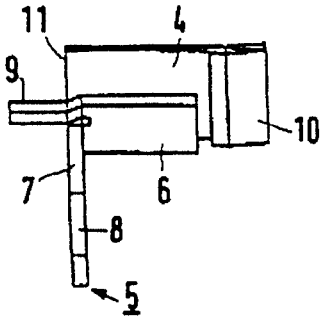
Figure 2B:
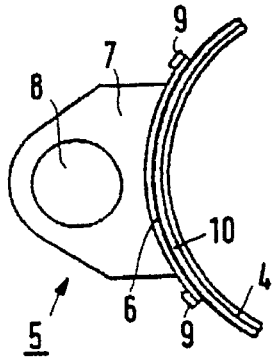
Figure 2C:
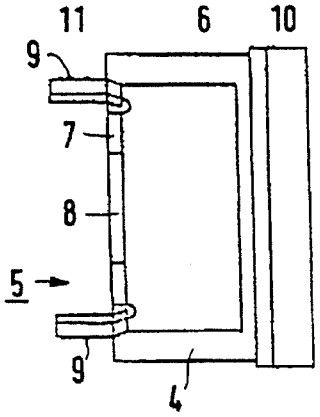
Figure 2D:
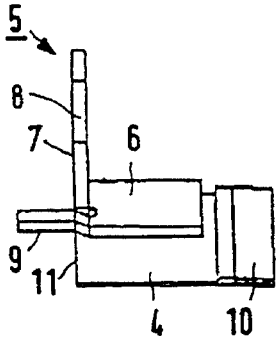
Figure 2E:
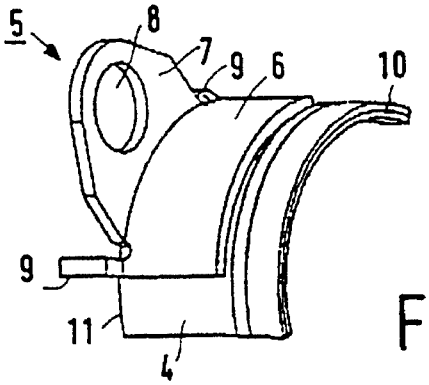
Figure 2F:
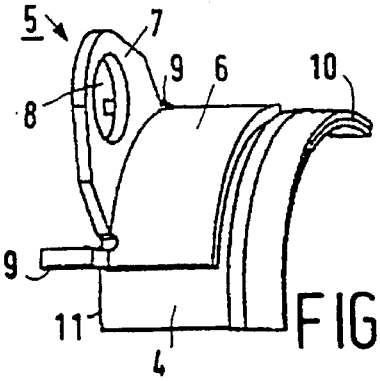
Figure 3:
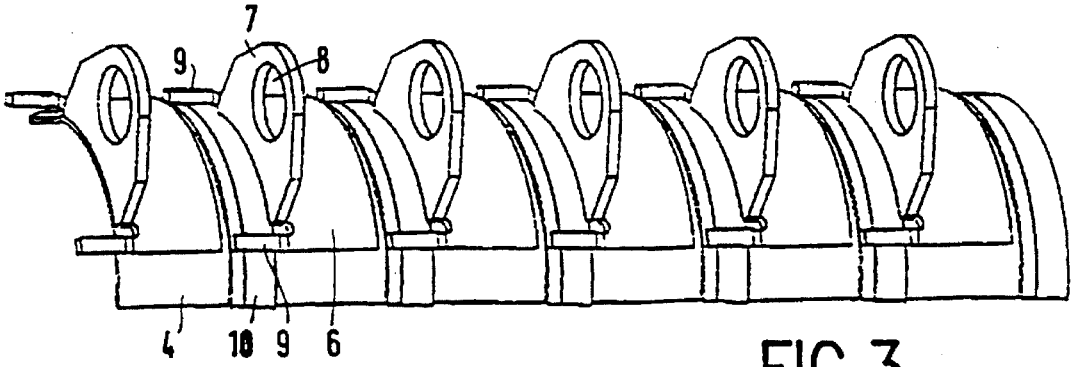
FIG. 3 shows corners of clamping bands stacked on top of each other.

FIG. 1 is a perspective view of a cathode ray tube having an evacuated envelope. This envelope comprises a display window 1, a cone-shaped portion 2 and a neck portion 3. In the neck there is accommodated an electron gun (not shown). The display window has a raised edge. An anti-implosion band 4 is clamped around the raised edge. This band will hereinafter also be referred to as clamping band 4. Suspension elements 5 are provided on the corners of the clamping band 4. FIGS. 2A up to and including 2F are different perspective views of a corner of a clamping band 4 having a suspension element 5. The suspension element comprises a first portion 6 which is secured to the clamping band 4, a second portion 7 having a suspension aperture 8, which portion extends transversely to the clamping band and, in this example, substantially parallel to the plane of the clamping band. The suspension element 5 further comprises projections 9 which extend on one side of the clamping band. FIGS. 2A and 2D are views transversely to the diagonal of the clamping band. FIG. 2B is a view transversely to the second portion 7 with the suspension aperture 8. FIG. 2C is a view transversely to the first portion 6. FIGS. 2E and 2F are perspective views of the corner of the clamping band and the suspension element. FIG. 2B shows that, viewed in projection on the plane of the anti-implosion band, the edge 10 of the anti-implosion band located opposite the projections falls within the projections 9. The projection 9 exhibits a small outward bend. By virtue of this bend an anti-implosion band can more easily be stacked on the preceding anti-implosion band. Preferably, portion 7 extends between the edges 10 and 11 of the anti-implosion band. Then the portions 7 do not project upwardly or downwardly relative to the anti-implosion band. Consequently, the risk of these portions becoming damaged during stacking is reduced as compared to a construction in which portions 7 and 8 do project upwardly or downwardly relative to the anti-implosion band. The projections do not affect the clamping action of the band. The bands can be readily stacked on top of each other. FIG. 3 shows a detail of a stack of anti-implosion bands. In this example, the corners of the anti-implosion bands are shown. It is clearly visible how the corners of the anti-implosion bands are stacked on top of each other. The projections are means for aligning anti-implosion bands with each other during stacking. Unlike the aligning means of known anti-implosion bands, these aligning means do not comprise suspension eyelets. Thus, the risk that the suspension eyelets are damaged is reduced.

Figure 4:
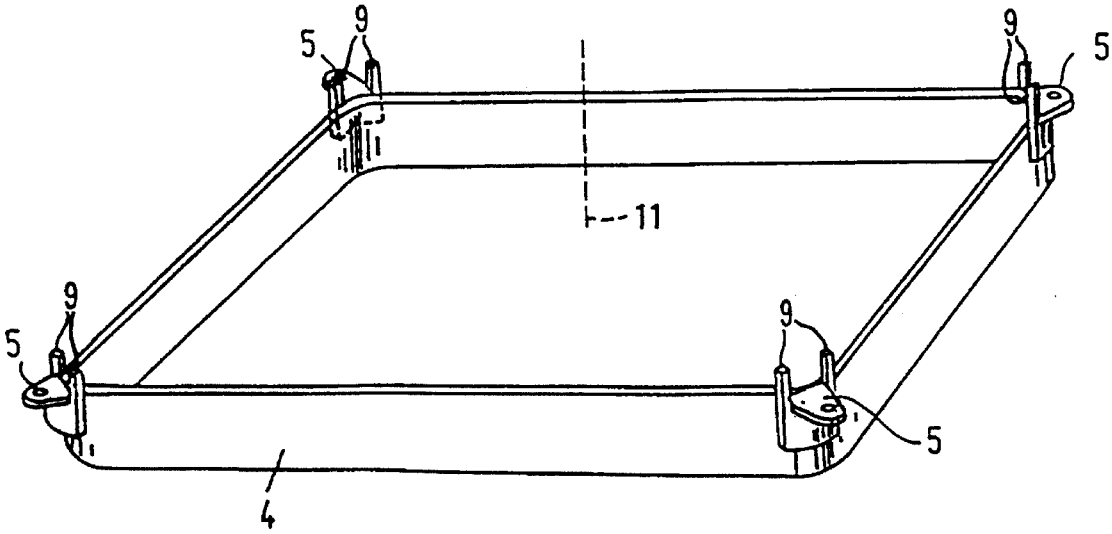
FIG. 4 shows an anti-implosion band.

FIG. 4 shows an anti-implosion band 4. This anti-implosion band is approximately rectangularly shaped and centered around an axis 11. The plane of the anti-implosion band extends transversely to the centering axis 11. The diagonal of the anti-implosion band is formed by a line through two oppositely located corners. It will be clear that "extending in an upward or downward direction relative to the anti-implosion band" is to be understood to mean within the scope of the invention that in a horizontal position of the anti-implosion band, for example as diagrammatically shown in FIG. 4, the projections extend in an upward direction relative to the anti-implosion band or if the anti-implosion band is inverted the projections extend in a downward direction relative to the anti-implosion band.

Preferably, the suspension element comprises, with respect to the diagonal through the relevant corner, two projections on either side of the second portion and, preferably, the suspension element is solidly constructed.

The use of eight projections, two on each corner on either side of the second portion, enables the anti-implosion bands to be stacked in a simple manner and the risk that a clamping band is rotated relative to an underlying or overlying clamping band is small. The suspension element can be solidly constructed in a simple manner. Rotation of an anti-implosion band relative to an overlying or underlying anti-implosion band may cause the stack as a whole, which consists of a plurality of anti-implosion bands, to assume a helical shape. This has the following disadvantages: the stack takes up more space than it does when no rotation occurs and the stack is less stable, i.e. it is more likely to fall over or move.

The invention is not limited to the above examples. The anti-implosion band shown is a so-called shrinkage band, i.e. a band which is provided around the envelope in a heated state and, after cooling, surrounds the envelope, in this example the raised edge of the display window, under a mechanical stress. In further examples, the anti-implosion band can be clamped around the envelope by tightening it. In the examples the fixing elements are secured to the outside of the anti-implosion band. The examples show suspension apertures 8. The specific shape of the suspension apertures is not important for a proper understanding of the invention. The suspension apertures may be in the form of round holes as shown in the examples, or half-open holes or they may even consist of only an edge on which a clamping element which is for example present in the cabinet can be mounted.

Figure 5:
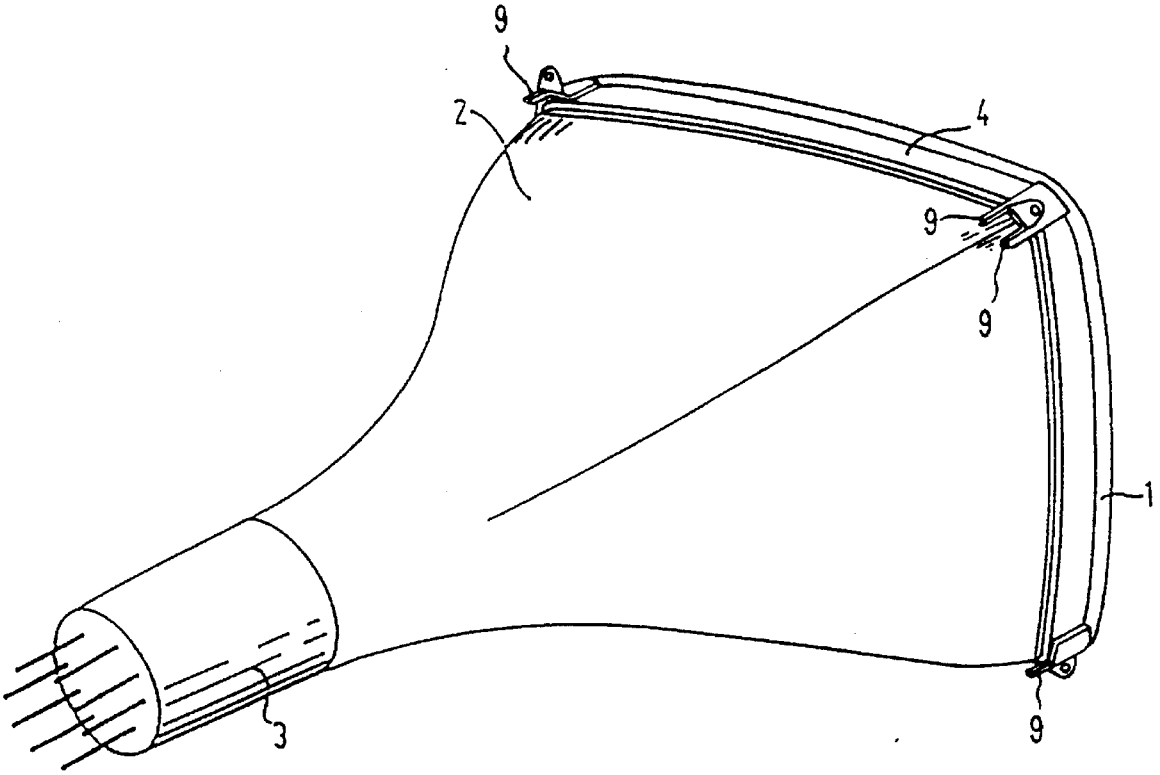
FIG. 5 shows a further example of a cathode ray tube in accordance with the invention.

FIG. 5 shows a further example of a cathode my tube having an anti-implosion band. In this example the projections are oriented toward the side of the cathode ray tube where the electron gun is situated.

I claim:

1. An improved anti-implosion band structure for a cathode ray tube having suspension elements with suspension apertures secured to an anti-implosion band comprising:

(a) a portion of each suspension element extending transversely to a surface of the anti-implosion band, said portion including said suspension apertures, and (b) at least one projection extending transverse to said portion and parallel to said surface of said anti-implosion band, said at least one projection extending beyond an edge of said anti-implosion band, and said at least one projection extending away from said edge.

2. An improved anti-implosion band structure according to claim 1, wherein said anti-implosion band is substantially rectangular, and wherein two of said projections are disposed at sides of corners of said anti-implosion band.

3. An improved anti-implosion band structure according to claim 2, wherein one of said suspension apertures is disposed between said two projections at each corner of said anti-implosion band.

4. An improved anti-implosion band structure according to claim 1, wherein said suspension elements are of solid construction.

5. A cathode ray tube having an anti-implosion band structure as claimed in claim 1.

6. A plurality of anti-implosion bands, each of said plurality of anti-implosion bands being an improved anti-implosion band for a cathode ray tube having suspension elements with suspension apertures secured to an anti-implosion band comprising:

(a) a portion of each suspension element extending transversely to a surface of the anti-implosion band, said portion including said suspension apertures, and (b) at least one projection extending transverse to said portion and parallel to said surface of said anti-implosion band, said at least one projection extending beyond an edge of said anti-implosion band, and said at least one projection extending away from said edge, wherein each of said plurality of anti-implosion bands is separated from the next of said plurality of anti-implosion bands by said at least one projection.

* * * * *